US005620090A

United States Patent [19]

Beeley

[11] Patent Number: 5,620,090

[45] Date of Patent: Apr. 15, 1997

[54] SCREWDRIVER KIT

[76] Inventor: Robert A. Beeley, P.O. Box 55549, Houston, Tex. 77255

[21] Appl. No.: 413,896

[22] Filed: Mar. 30, 1995

[51] Int. Cl.[6] ..... A45C 11/00; B65D 69/00

[52] U.S. Cl. ..... 206/234; 81/439; 206/37; 206/372

[58] Field of Search ..... 81/437, 438, 439; 206/234, 372, 373, 349, 37, 38, 37.1, 38.1

[56] References Cited

U.S. PATENT DOCUMENTS

| | | | |
|---|---|---|---|
| 1,441,950 | 1/1923 | Simon | 81/439 |
| 4,037,275 | 7/1977 | Schor | 81/437 |
| 4,037,716 | 7/1977 | Marks | 206/38 |
| 4,300,610 | 11/1981 | China | 206/37 X |
| 4,637,236 | 1/1987 | Almblad | 70/458 |
| 4,677,835 | 7/1987 | Almblad | 70/456 R |
| 4,901,547 | 2/1990 | Del Palú | 206/38.1 X |
| 4,946,030 | 8/1990 | Gundi et al. | 206/37.1 |
| 5,328,026 | 7/1994 | Newman | 206/234 |

*Primary Examiner*—Bryon P. Gehman

[57] ABSTRACT

A screwdriver kit which comprises a flat card-like member with slots for housing components of the screwdriver. The slots are all interior of the edges of the flat card like member. A back member supports the card-like member and is for retaining the components in their slots.

3 Claims, 1 Drawing Sheet

FIG. 1
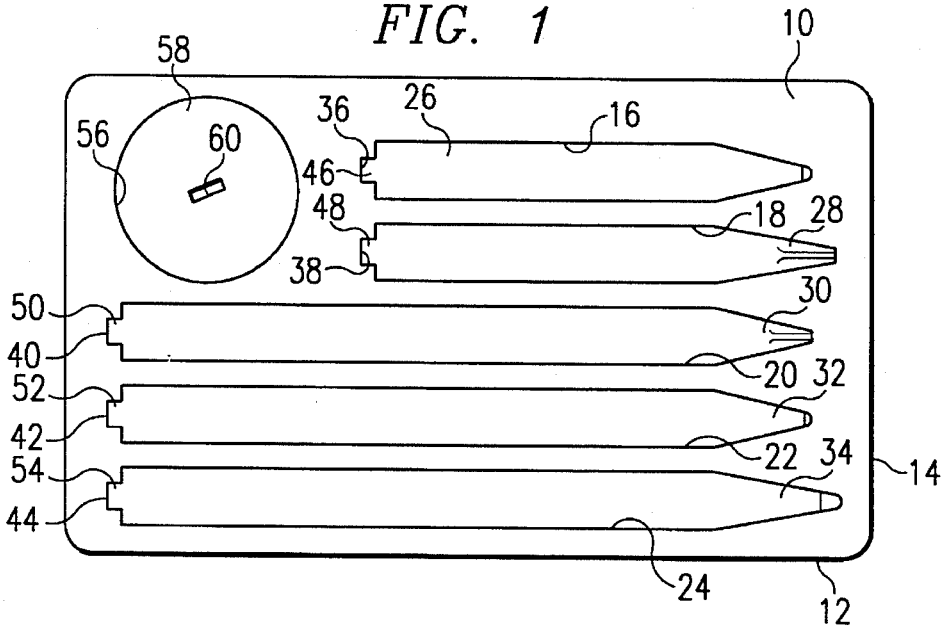
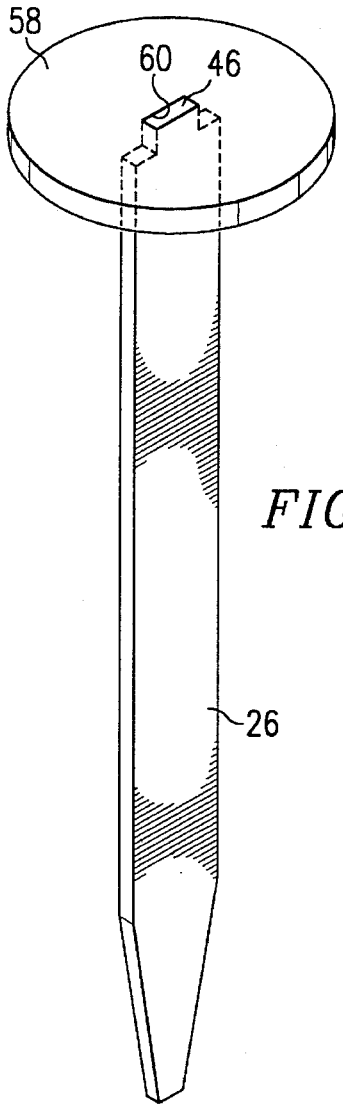
FIG. 2

SCREWDRIVER KIT

BACKGROUND OF THE INVENTION

The present invention relates to screwdriver kits which are compact, portable and economical and which house and carry a plurality of screwdriver tips. There has long been a need for such screwdriver kits in a large variety of applications. The present invention fulfills this need by offering a screwdriver kit which is very thin, which can be carried in a wallet and a purse, and which carries a screwdriver components of sufficient strength which can easily be assembled and utilized.

There are prior references which disclose combination keys and cards or flat tool holders. U.S. Pat. No. 5,328,026 discloses a flat tool holder having interior and exterior positions, with the interior portion configured with a series of pockets extending inwardly of the edges of the interior portion. The exterior and interior portions form a sandwich. The tools can be slid into the pockets extending inwardly on the edges of the interior. The profile of the tools generally match the profile of the pockets extending inwardly on the edges of the interior. This reference, however, does not disclose a portable tool kit which allows the insertion of tools or components from any location other than from the side edges of the interior portion of this sandwich like assembly.

U.S. Pat. No. 4,037,275 discloses a sportsman's wrench and screwdriver. The disclosure in this patent is described as having a plurality of radially extending screwdriver heads with the interior having a plurality of wrench holes. It does not disclose a portable kit capable of holding a plurality of interchangeable screwdriver tip components.

U.S. Pat. No. 4,637,236 is for a key and retainer card combination. In one embodiment of this invention, the key is hinged in position for use. In another embodiment, it is described that the key is attached by breakaway tabs, although there is no explanation of where or how these breakaway tabs are formed, or how they function as breakaway tabs. In another embodiment, the card and the key are manufactured separately and are adapted to fit into slots of the card when assembled.

U.S. Pat. No. 4,677,835 discloses a plastic card, key combination and hinge assembly. The hinge assembly is described as allowing the key to be swung out of the plane of the card and allowing for twisting of the key. The hinge means is furthered described as comprising generally a rod-shaped elongated element.

U.S. Pat. No. 4,286,641 discloses a combination business card and key storage device. The device is described as having an enclosure that is planar with one or more slits appropriately sized for the insertion or removal of the keys.

The foregoing references cited herein do not disclose the present invention of a flat, thin card-like screwdriver kit.

SUMMARY OF THE INVENTION

The present invention is a thin, card like kit having one or more of a plurality of pockets for the storage of screwdriver components. The kit is comprised of a flat card like member with a backing. The backing provides support and is generally of the same length and thickness of the card. The pockets are located interior of the edges of the flat card like member. These screwdriver components are easily and quickly removable from the pockets in the card. Once removed, the screwdriver components can be assembled and used. The screwdriver components can include a variety of different screwdriver tips and a handle. One end of the screwdriver tip has a tab for insertion into the handle, whereas the other end is the working end. The handle can be a wheel having an opening for insertion of the tab. The handle or wheel is used to turn the screwdriver tip. The entire kit is flat and thin when not in use.

One of the objectives of the present invention is to provide a thin flat screwdriver kit that can be carried like a credit card in a wallet or in a purse, and that can carry a plurality of screwdriver components and tips that can easily be assembled and used.

Another objective of the present invention is to provide a kit for screwdrivers that can carry a variety of screwdriver tip such as straight, Phillips, and/or Torx along with a wheel type handle.

A further objective of this invention is to provide a portable screwdriver kit with a wheel handle and screwdriver kits which can be carried in a pocket or wallet.

Still yet another objective is to provide a kit for screwdriver kit with components attached with break away tabs which kit is thin, flat, and easily portable.

Other objectives of the present invention will be apparent to those who have skill in the art.

BRIEF DESCRIPTION OF THE DRAWINGS

In the following description of the invention, reference will be made to the following drawings.

FIG. 1 is a drawing of the screwdriver kit of the present invention from the top view disclosing a variety of tips and a circular hand wheel.

FIG. 2 is a drawing of one of the tips of the kit of FIG. 1 and the hand wheel assembled for use.

DETAILED DESCRIPTION OF THE INVENTION

Referring to the drawings, there is illustrated a flat screwdriver kit generally described as 10. As shown in FIG. 1, the kit 10 is comprised of a card like member 12. The card like member 12 is thin and flat much like a credit card or a driver's license. The member 12 can be made of a large variety of materials, such as the types of plastic that are used in credit cards. Supporting the card like member 12 is a thin, flat backing or sheet 14 of roughly the same length and width as member 12. The backing or sheet 14 serves as backing for the card like member 12 and keeps the components from falling through the pockets of the card like member 12. The backing or sheet 14 does not have any pockets or slots. The backing or sheet 14 can be attached to the card like member 12 by a variety of conventional methods, such as by glue.

The member 12 of the screwdriver tool kit of FIG. 1 has first pockets or slots 16, 18, 20, 22, and 24 for housing or storing a variety of screwdriver blades or tips 26, 28, 30, 32, and 34. Each of these pockets or slots has a profile that compliments the profile of the screwdriver tip stored in the pocket or slot. As shown in FIG. 1, these first pockets or slots 16, 18, 20, 22, and 24 have an elongated blade shape culminating at one end. This is the working end of the component. Each of these pockets or slots is located interior of the edges of the card member 12 so that the tips fit into the pockets from the top side of the member 12. The tips cannot be slipped into the pockets from the side of the member 12 because the slots or pockets 16, 18, 20, 22 and 24 do not extend to the edges. Further, the blades or tips 26, 28, 30, 32, and 34 could have tips that are straight, Phillips and/or Torx.

The first slot or pockets 16, 18, 20, 22, and 24 have a recess 36, 38, 40, 42 and 44 at one end. These recesses compliment tabs 46, 48, 50, 52 and 54 of tips 26, 28, 30, 32 and 34.

The member 12 of the screwdriver tip also has a second pocket or slot of circular shape. This second pocket or slot 56 houses handle 58. At the center of handle 58 is opening 60. The opening 60 is for receiving the tab end 46, 48, 50, 52 and 54 of the tips 26, 28, 30, 32 and 34 allowing attachment of a tip to handle 58. As shown in FIG. 1, the handle 58 is wheel shaped. This is just one example of the shape or type of handle that can be used for the screwdriver kit and still fall within the scope of the invention.

FIG. 2 shows an example of one of the screwdriver tips assembled with handle or wheel 58. Specifically, FIG. 2 shows tab end 46 of tip 26 inserted into opening 60 of handle 58. As shown, the handle 58 provides means for turning the tip. The exterior of handle 58 can be scored so as to provide a better surface for gripping the screwdriver.

Each of the tab ends 46, 48, 50, 52, and 54 can be inserted into the opening 60 of handle 58. The method of a tab end being inserted into an opening is just an example of one means of attaching the screwdriver tips to the handle. Other means of attachment will be apparent to those who are skilled in the art.

The number tips shown in FIG. 1 are just exemplary of one embodiment of the present invention. There could be more or fewer tips and still fall within the scope of the present invention.

The tips and handle 58 shown in FIG. 1 can be easily removed for use, and then returned to their respective slots or pockets for storage for further use. After the tips and handle 58 are returned to their respective slots or pockets, the tips and handle may be retained in the kit by a variety of conventional means.

The tips and handle can be made of the same material as the member 12, or alternatively can be made from a different material. For example, the tips and handle as well as the card member may all be made from plastic. Alternatively, the card member 12 could be made from plastic, whereas the tips and handle could be made from a harder material such as steel. If the tips, handle and card member are all made from the same material, then all of the elements of the kit could be at the same time by punching out or cutting out the elements from the card. The punching out or cutting out process leaving each of the handles or tips with break-away tabs. The break-away tabs would retain the handle and the tips with the card until used.

I claim:

1. A screwdriver kit comprising a flat card member having exterior edges;

said flat card member having a first pocket and a second pocket located interior of the edges wherein the first pocket has a wheel shape;

a support member attachable to the flat card member, said support member having generally the same length and width as the flat card member;

a screwdriver handle retained in the first pocket of the flat card member, the screwdriver handle having a wheel shape; and a screwdriver blade having a straight tip at one end retained in the second pocket of the flat card member.

2. The screwdriver kit of claim 1 wherein the second pocket has an elongated blade shape culminating at one end with a straight portion.

3. The screwdriver kit of claim 2 wherein the second pocket culminates at one end with a recess, the screwdriver handle has an opening at its center, and the screwdriver blade has a tab at one end for insertion into the opening of the screwdriver handle.

* * * * *